US007490601B2

(12) United States Patent
Tiegs

(10) Patent No.: US 7,490,601 B2
(45) Date of Patent: Feb. 17, 2009

(54) DEVICE AND METHOD FOR REDUCING FIREPLACE PARTICULATE EMISSIONS

(76) Inventor: Paul E. Tiegs, P.O. Box 743, Beaverton, OR (US) 97075

( * ) Notice: Subject to any disclaimer, the term of this patent is extended or adjusted under 35 U.S.C. 154(b) by 0 days.

(21) Appl. No.: 11/825,589

(22) Filed: Jul. 5, 2007

(65) Prior Publication Data

US 2007/0256616 A1 Nov. 8, 2007

Related U.S. Application Data

(63) Continuation of application No. 11/101,674, filed on Apr. 8, 2005, now Pat. No. 7,275,929, which is a continuation of application No. 10/745,406, filed on Dec. 22, 2003, now Pat. No. 6,968,838.

(51) Int. Cl.
*F24B 1/18* (2006.01)

(52) U.S. Cl. ..... 126/500; 431/5; 431/7; 431/170; 110/212

(58) Field of Classification Search ..... 431/5, 431/7, 170; 60/299, 300, 301, 303; 110/210–214, 110/344, 345; 422/168, 182, 183; 126/77, 126/500
See application file for complete search history.

(56) References Cited

U.S. PATENT DOCUMENTS

| | | | | | |
|---|---|---|---|---|---|
| 2,845,882 | A * | 8/1958 | Bratton | 110/346 |
| 3,468,634 | A * | 9/1969 | Pauletta | 422/170 |
| 3,806,322 | A * | 4/1974 | Tabak | 422/170 |
| 3,817,716 | A * | 6/1974 | Betz | 422/171 |
| 4,138,220 | A * | 2/1979 | Davies et al. | 422/173 |
| 4,213,947 | A * | 7/1980 | Fremont et al. | 423/245.3 |
| 4,319,556 | A * | 3/1982 | Schwartz et al. | 126/77 |
| 4,385,031 | A * | 5/1983 | Fratzer et al. | 422/176 |
| 4,385,032 | A * | 5/1983 | Fratzer et al. | 422/176 |
| 4,476,852 | A * | 10/1984 | Lee et al. | 126/289 |
| 4,479,921 | A * | 10/1984 | Allaire et al. | 422/180 |
| 4,582,044 | A * | 4/1986 | Ferguson et al. | 126/289 |
| 4,862,869 | A * | 9/1989 | Hazard | 126/77 |
| 5,014,680 | A * | 5/1991 | Siemer | 126/77 |
| 5,228,847 | A * | 7/1993 | Lywood et al. | 431/7 |
| 5,295,448 | A * | 3/1994 | Vickery | 110/214 |
| 5,460,511 | A * | 10/1995 | Grahn | 431/5 |
| 5,499,622 | A * | 3/1996 | Woods | 126/500 |
| 5,975,890 | A * | 11/1999 | Kawasaki et al. | 431/328 |
| 7,275,929 | B2 * | 10/2007 | Tiegs | 431/125 |
| 2002/0064739 | A1 * | 5/2002 | Boneberg et al. | 431/5 |

* cited by examiner

*Primary Examiner*—Carl D Price
(74) *Attorney, Agent, or Firm*—Rylander & Associates PC; Kurt M. Rylander; Mark E. Beatty

(57) ABSTRACT

A fireplace afterburner is presented including a shell having a first open shell end for receiving fireplace emissions and a second open shell end for expelling fireplace emissions, a flue inside said shell having a first flue end which can be closed, and a second flue end which is open, wherein when the first flue end is closed fireplace emissions flow around said flue, and wherein when said first flue end is open fireplace emission flow through said flue, a heating element connected to said shell and encircling said flue, wherein said heating element heats emissions that pass in proximity to the element, and a catalyst bed connected to said shell and encircling said flue. A method for reducing products of incomplete combustion in fireplace emissions is presented including receiving fireplace emissions into a shell, heating said fireplace emissions to at least 1501° F. (816° C.), reacting said fireplace emissions with a catalyst substrate, and releasing the results of said reaction from said shell.

8 Claims, 2 Drawing Sheets

DEVICE AND METHOD FOR REDUCING FIREPLACE PARTICULATE EMISSIONS

CROSS-REFERENCE TO RELATED APPLICATION

This continuation application claims priority to Non-Provisional application Ser. No. 11/101,674, filed Apr. 8, 2005 now U.S. Pat. No. 7,275,929, which is a continuation-in-part of and claims priority to Non-Provisional application Ser. No. 10/745,406, filed Dec. 22, 2003 now U.S. Pat. No. 6,968,838.

FIELD OF THE INVENTION

The present invention relates to fireplaces. More particularly, the present invention relates to methods and apparatuses to reduce combustion emissions in fireplace exhausts.

BACKGROUND

The process of burning batch-loaded wood in ambient air at atmospheric conditions begins with the application of sufficient heat (greater than approximately 350° F. (177° C.)) to initiate a self-sustaining combustion process. Heating first causes moisture contained in the fuel to evaporate into the space in the immediate vicinity of where the fuel heating is taking place with subsequent dispersion into the atmosphere. As fuel moisture is depleted in the area of the fuel being heated, the organic components of the fuel , consisting of but not limited to such compounds as lignin, hemicellulose, and cellulose, begin to break down by way of a thermal process called pyrolysis. Pyrolysis includes both oxidation and reduction reactions initiated by the increasing temperature of the fuel. Virtually all of the formed and reformed chemical species produced by the pyrolysis process are organic species ranging from simple methane and formaldehyde to complex molecules such as benzo-a-pyrene and some notorious toxins like dioxins.

At the temperatures at which wood pyrolysis reactions take place (i.e., generally above 300° F. (149° C.)) virtually all of the pyrolysis reaction products leave a burning piece of wood in a gaseous phase. This means that, at atmospheric conditions, the pyrolysis products will migrate or disperse out of and away from the wood fuel being heated. As these gases, all of which are combustible, leave the surface of the fuel they mix with air and it's 20.9% oxygen content. At the mixing point where there are combustible gases within the range of flammability concentrations and there is adequate temperature, generally above 600° F. (316° C.), the pyrolysis product and air mixture will generate a self-sustaining combustion process usually observed as flaming.

If the pyrolysis-product gases are too rich, become too diluted by air, or there is inadequate temperature to initiate a self-sustaining combustion process the pyrolysis-product gases will not "burn" and they will leave the combustion zone either as gaseous pollutants or as condensation droplets or aerosols which make up what is generally referred to as smoke or particulate emissions. If the pyrolysis products are only partially combusted as they leave the wood, carbon monoxide and solid particulate carbon particles known as soot are formed. When these incompletely combusted liquids and solids condense and are deposited on inner chimney walls the resulting formations are called creosote.

If excessive dilution takes place in the combustion zone, the concentration of those pyrolysis-product compounds that typically produce smoke particles in flue gases can be reduced to levels below their condensation vapor pressures. When this occurs, little or no smoke is observed in the flue gases. Even though concentrations may get diluted to levels below their respective condensation vapor pressures, the total mass of emitted materials remains in the flue gases.

Since the elemental makeup of wood consists primarily of carbon, hydrogen, and oxygen, the complete combustion of wood and it's pyrolysis products consists nominally of carbon dioxide and water. Small amounts of nitrogen and sulfur are present in wood at tenth of a percent levels and form nitrous oxides and sulfur oxides respectively when wood is burned. Other inorganic constituents of wood include the salts of calcium, sodium, potassium, magnesium, iron, silicon, chlorine, and phosphorus, which comprise virtually the total make up of the ash materials left after complete wood combustion has taken place.

To accomplish the compete combustion of wood it would first be necessary to heat the fuel evenly throughout and then as the various species of gaseous pyrolysis products are produced they would be evenly mixed with the appropriate amounts of air for ideal combustion and then evenly heated further to the appropriate temperature for initiating combustion (i.e., ignition temperature). This complete or ideal combustion process requires an ideal set of conditions that do not occur under the natural conditions found in fireplace combustion chambers. Under normal and typical fireplace conditions pieces of wood are being heated unevenly with some areas reaching temperatures adequate to initiate pyrolysis but not hot enough or uniform enough to generate enough combustible gas to initiate combustion. Because fuel heating in a fireplace is so uneven throughout the burning of a fuel load, there will always be zones, like near where flaming is occurring, where temperatures are hot enough to cause the production of pyrolysis products but not hot enough to cause them to burn or they become too dilute by mixing with air to burn. In either case, there are pyrolysis products, products of incomplete combustion (PICs), escaping the combustion zone and, if there are no further steps taken to combust these materials, they become pollutants discharged to the atmosphere.

Thus, there is a need for a method and apparatus to reduce or eliminate the products of incomplete combustion of wood in a fireplace. Presently known art attempts to address this problem, but has not completely solved the problem. The following represents a list of known related art:

| Reference: | Issued to: | Date of Issue: |
|---|---|---|
| U.S. Pat. No. 6,237,587 | Sparling et al. | May 29, 2001 |
| U.S. Pat. No. 5,499,622 | Woods | Mar. 19, 1996 |
| U.S. Pat. No. 6,227,194 | Barudi et al. | May 8, 2001 |
| U.S. Pat. No. 4,249,509 | Syme | Feb. 10, 1981 |
| U.S. Pat. No. 3,496,890 | La Rue | Feb. 24, 1970 |
| U.S. Pat. No. 4,422,437 | Hirschey | Dec. 27, 1983 |
| U.S. Pat. No. 5,460,511 | Grahn | Oct. 24, 1995 |

The teachings of each of the above-listed citations (which does not itself incorporate essential material by reference) are herein incorporated by reference. None of the above inventions and patents, taken either singularly or in combination, is seen to describe the instant invention as claimed.

Thus, while the foregoing body of art indicates it to be well known to have a fireplace afterburner, the art described above does not teach or suggest a fireplace afterburner which has the following combination of desirable features: (1) adjustable to fit in different sizes of fireplace; (2) adjustable for utilizing different fuel-gas including natural gas, propane, butane, or any mixture of fuel gases; (3) can utilize many catalytic materials that can enhance the oxidation of organic molecules in air; (4) can reduce wood-burning pollutant emissions, PICs, without utilizing catalytically-active materials; (5) can utilize different kinds of catalyst substrate (e.g., metal or ceramic) suitable for withstanding temperatures of up to 2300° F. (1260° C.) and different shape (e.g., honeycomb or reticulated foam) suitable for allowing the amount of flue-gas flow needed to prevent smoke spillage out the front of the fireplace on which it is installed; (6) when used with catalytically active materials, raises the temperature of fireplace flue gases (i.e., the total flue-gas stream) to at least 1501° F. (816° C.) which is the temperature at which some of the wood-burning pyrolysis products begin to oxidize to carbon dioxide and water; (7) can use either "natural" draft (i.e., the rising of heated gases in a duct) or induced draft (i.e., mechanically-assisted by a fan) to produce the flow of air and combustion gases through a chimney system duct necessary for maintaining proper fireplace operations and the exhaust of flue-gases to the atmosphere; (8) can be equipped with a catalyst-bed bypass to facilitate flue-gas flow during initial startup heating and to alleviate possible blockage of the catalyst; (9) can be equipped with an automatic catalyst bed temperature controller for maintaining minimum catalyst temperatures or preventing excessive temperatures that may be generated within the system during fireplace operation; (10) can be equipped with an electronic temperature sensor placed within the catalyst bed which can send a signal to an electrical-mechanical device which allows for moderating the heating source (i.e., increasing or decreasing the fuel-gas supply or electrical power source) within the minimum and maximum operating temperature range; (11) can be equipped with an emergency shut-down (i.e., failsafe) system that would turn off all fuel-gas flow or electrical power if excessive temperatures are reached or the operator detects a malfunctioning system.

SUMMARY AND ADVANTAGES

The fireplace afterburner of the present invention is insertable in the standard chimney exhaust flues. The afterburner reduces products of incomplete combustion (PIC) emissions generated by the process of burning wood and wood-derived fuels in ambient air at atmospheric conditions. The afterburner reduces PIC emissions from appliances or structures widely referred to as "fireplaces" in North America. PICs are reduced by receiving fireplace emissions into a shell, heating said fireplace emissions to at least 1501° F. (816° C.), reacting said fireplace emissions with a catalyst substrate, and expelling the results of said reaction from said shell.

The fireplace afterburner of the present invention includes a shell having a first open shell end for receiving fireplace emissions and a second open shell end for expelling fireplace emissions, a flue inside said shell having a first flue end which can be closed and a second flue end which is open, wherein when the first flue end is closed fireplace emissions flow around said flue, and wherein when said first flue end is open fireplace emissions flow through said flue, a heating element connected to said shell and encircling said flue, wherein said heating element heats emissions that pass in proximity to the element, and a catalyst bed connected to said shell and encircling said flue.

The afterburner of the present invention presents numerous advantages, including: (1) adjustable to fit in different sizes of fireplace; (2) adjustable for utilizing different fuel-gas including natural gas, propane, butane, or any mixture of fuel gases; (3) can utilize many catalytic materials that can enhance the oxidation of organic molecules in air; (4) can reduce wood-burning pollutant emissions, PICs, without utilizing catalytically-active materials; (5) can utilize different kinds of catalyst substrate (e.g., metal or ceramic) suitable for withstanding temperatures of up to 2300° F. (1260° C.) and different shape (e.g., honeycomb or reticulated foam) suitable for allowing the amount of flue-gas flow needed to prevent smoke spillage out the front of the fireplace on which it is installed; (6) when used with catalytically active materials, raises the temperature of fireplace flue gases (i.e., the total flue-gas stream) to at least 1501° F. (816° C.) which is the temperature at which some of the wood-burning pyrolysis products begin to oxidize to carbon dioxide and water; (7) can use either "natural" draft (i.e., the rising of heated gases in a duct) or induced draft (i.e., mechanically-assisted by a fan) to produce the flow of air and combustion gases through a chimney system duct necessary for maintaining proper fireplace operations and the exhaust of flue-gases to the atmosphere; (8) can be equipped with a catalyst-bed bypass to facilitate flue-gas flow during initial startup heating and to alleviate possible blockage of the catalyst; (9) can be equipped with an automatic catalyst bed temperature controller for maintaining minimum catalyst temperatures or preventing excessive temperatures that may be generated within the system during fireplace operation; (10) can be equipped with an electronic temperature sensor placed within the catalyst bed which can send a signal to an electrical-mechanical device which allows for moderating the heating source (i.e., increasing or decreasing the fuel-gas supply or electrical power source) within the minimum and maximum operating temperature range; (11) can be equipped with an emergency shut-down (i.e., failsafe) system that would turn off all fuel-gas flow or electrical power if excessive temperatures are reached or the operator detects a malfunctioning system.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

Figure 1:
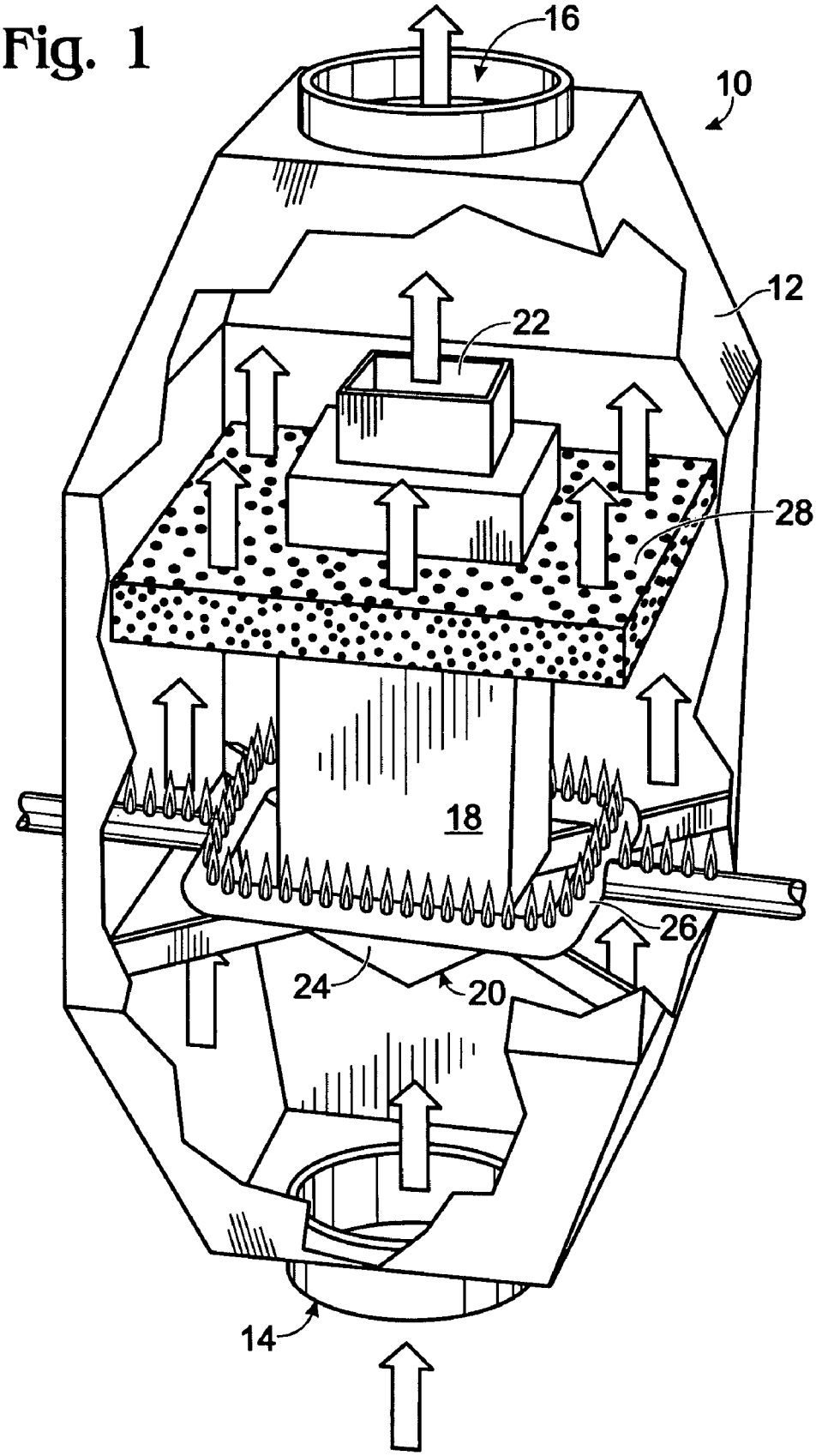
FIG. 1 shows a perspective cutaway view of an embodiment of the present invention.

| Reference Numerals in Drawings | |
|---|---|
| 10 | Fireplace afterburner |
| 12 | Shell |
| 14 | First open shell end |
| 16 | Second open shell end |
| 18 | Flue |

-continued

| Reference Numerals in Drawings | |
|---|---|
| 20 | First flue end |
| 22 | Second flue end |
| 24 | Doors |
| 26 | Heating element |
| 28 | Catalyst bed |

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 3:
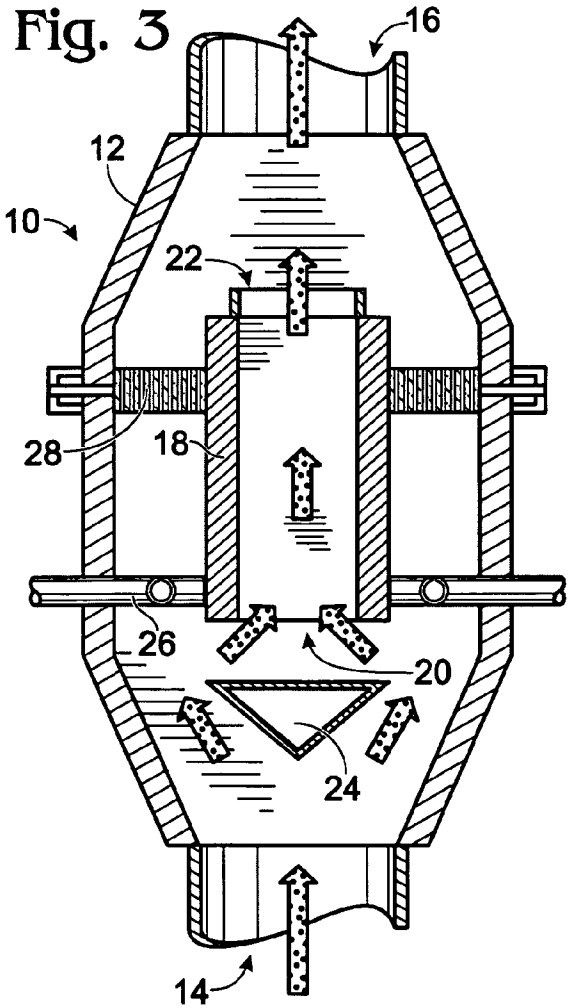
FIG. 3 shows another side cutaway view of an embodiment of the present invention.
Figure 2:
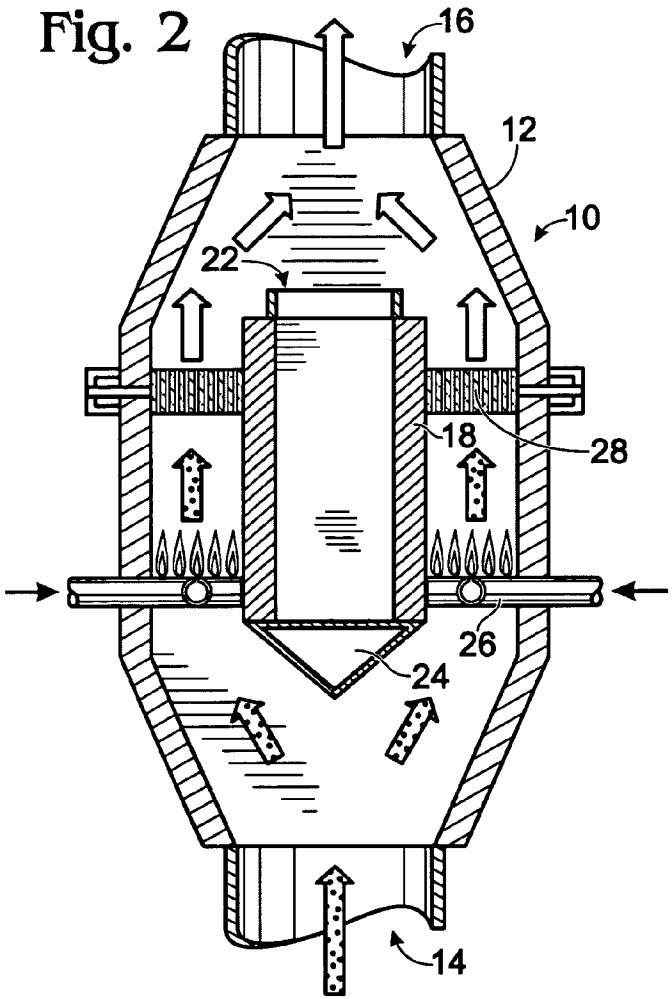
FIG. 2 shows a side cutaway view of an embodiment of the present invention

As shown in FIGS. 1-3, a fireplace afterburner 10 is provided comprising a shell 12 having a first open shell end 14 for receiving fireplace emissions and a second open shell end 16 for expelling fireplace emissions, a flue 18 inside said shell having a first flue end 20 which can be closed and a second flue end 22 which is open, wherein when, as shown in FIGS. 1, 2, the first flue end is closed fireplace emissions flow around said flue, and wherein when, as shown in FIG. 3 said first flue end is open fireplace emissions flow through said flue 18, a heating element 26 connected to said shell and encircling said flue, wherein said heating element heats emissions that pass in proximity to the element, and a catalyst bed 28 connected to said shell and encircling said flue.

The shell 12 is preferably made of sheet metal and is attachable to the exhaust flue of standard chimney exhausts. Those skilled in the art will know that there are numerous ways to connect the shell to a chimney exhaust flue. In the preferred embodiment, a portion of chimney exhaust flue equal in length to the shell is removed and the shell is inserted in its place, connecting to the exhaust flue at the first and second open shell ends, 14 and 16.

In the preferred embodiment, flue 18 inside the shell 12, connects to the shell with metal supports which can be bolted, welded, or other similar connection method, to the shell and the flue. In preferred embodiment, flue is a sheet metal cylinder connected to the shell by metal supports. Supports can be riveted to flue and shell, or welded, or other techniques well known to those skilled in the art. Flue has a first flue end 20 and a second flue end 22. First flue end 20 in preferred embodiment has doors 24 as shown in FIG. 1, which can be opened or closed. As shown in FIG. 2, when the first flue end 20 is closed fireplace emissions flow around said flue and by draft are forced to go by the heating element 26 and through the catalyst bed 28. As shown in FIG. 3, when the first flue end 20 is open fireplace emissions flow through said flue.

As shown in FIGS. 2 and 3, doors 24 in the preferred embodiment are shown as a stopper that slides downward, creating an entry to the flue 18 through which air can draft. Doors 24 in preferred embodiment can be attached to the inside of the flue by sliders or coaster, which allow the doors 24 to slide up and down to close or open the flue 18 to draft. Those skilled in the art will know that there a number of ways of providing a means for opening and closing the flue to allow draft or stop draft. For example, a hinged door could be attached to the flue, allowing the door to be swung open or shut. The invention is not limited by the ways in which a door or stopper can be attached and applied to the flue to selectively open or close the flue for draft.

Heating element 26 connected to said shell and encircles the flue. Heating element 26 heats emissions that pass in proximity to the element. In preferred embodiment, heating element 26 is a natural gas burner stainless steel tube with gas holes and an automatic igniter, such as those in natural gas furnaces, fireplaces, and barbeques. Heating element in preferred embodiment is connected to shell and flue with metal supports. Those skilled in the art will know that gas burners for heating element can come in many shapes and designs. Metal supports connect to heating element and to shell by bolts, welds, or other similar method for connecting metal to metal. A gas supply to the heating element provides the fuel for the heating element. Those skilled in the art will know that heating element can also be other means for heating gases other than natural gas burners, such as electrical heaters, which can connect directly to the electrical system of the building in which the afterburner is installed.

Catalyst bed 28 connects to said shell 12 and encircles said flue 18. Catalyst bed 28 temperatures greater than 1501° F. (816° C.) should be maintained in order to complete the combustion. Catalyst substrate of the catalyst bed is a ceramic honeycomb, preferably mullite, which is a commercially available ceramic honeycomb. Catalyst substrates, metal or ceramic, withstanding temperatures of up to 2300° F. (1260° C.) and any shape (e.g., honeycomb or reticulated foam) suitable for allowing the amount of flue-gas flow needed to prevent smoke spillage out the front of the fireplace on which it is installed. Catalyst bed is preferably wash-coated with palladium and platinum oxides.

The fireplace afterburner can be provided with an insulating blanket to improve the heating efficiency for PIC burning. Insulating blanket can be wrapped around the inside or outside of the afterburner shell 12.

The fireplace afterburner installs into an existing flue-gas flow pathway of a fireplace exhaust. Untreated fireplace exhaust gases enter through the first open shell end 14. The gases are heated by the heating element 26, which can either be an electrical-resistance heating element or a fuel-gas-fired burner system to temperatures of at least 1501° F. (816° C.) (electrical and electrical heater, would have to be bigger, natural gas is preferred). The gases then flow through the catalyst bed 28, and exit through the second open shell end 16 into the fireplace exhaust. Catalyst bed temperatures should be always maintained at least 1501° F. (816° C.). Final discharge is usually to the ambient atmosphere.

When used with catalytically active materials, raises the temperature of all fireplace flue gases (i.e., the total flue-gas stream) to at least 1501° F. (816° C.) which is the temperature at which some of the wood-burning pyrolysis products begin to oxidize to carbon dioxide and water; can use either "natural" draft (i.e., the rising of heated gases in a duct) or induced draft (i.e., mechanically-assisted by a fan) to produce the flow of air and combustion gases through a chimney system duct necessary for maintaining proper fireplace operations and the exhaust of flue-gases to the atmosphere.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A method for reducing products of incomplete combustion in a fireplace emissions stream, comprising receiving said fireplace emissions stream into a shell, wherein said shell includes a heating element in fluid communication with said emissions stream, a catalyst substrate downstream of said heating element in fluid communication with said emissions stream, a bypass flue within said shell having an inlet end upstream of said heating element and an outlet end downstream of said heating element, and a controllable damper connected to said bypass flue inlet end;

oxidizing wood-burning pyrolysis products in said fireplace emissions stream by selectively directing portion of said emissions stream to flow in proximity to said heating element by adjusting the position of said controllable damper, thereby heating said portion of said emissions stream to at least 1501° F (816° C.) and allowing an unprocessed portion of said emissions stream to bypass said heating element and said catalyst bed;

reacting said portion of said fireplace emissions with said catalyst substrate; and recombining said unprocessed portion of said emissions stream with said processed portion of said emissions stream;

releasing the products of said reaction from said shell.

2. The method of 1, wherein said shell has a first open shell end for receiving fireplace emissions and a second open shell end for releasing fireplace emissions.

3. The method of 2, wherein said catalyst substrate is a ceramic honeycomb.

4. The method of 3, wherein said catalyst bed honeycomb is wash-coated with either palladium oxide or a platinum oxide.

5. The method of 3, wherein said catalyst bed is mullite.

6. The method of 1, wherein said catalyst substrate is a ceramic honeycomb.

7. The method of 6, wherein said catalyst bed honeycomb is wash-coated with either palladium oxide or a platinum oxide.

8. The method of 2, wherein said catalyst bed is mullite.

* * * * *